US005940920A

United States Patent [19]

Hare et al.

[11] Patent Number: 5,940,920

[45] Date of Patent: Aug. 24, 1999

[54] PIPE CLEANING APPARATUS

[75] Inventors: Michael T. Hare, Farmington; Michael E. Stahle; Bruce L. Hare, Sr., both of Bloomfield, all of N.Mex.

[73] Assignee: Philip Services Corp., Columbia, Ill.

[21] Appl. No.: 08/891,481

[22] Filed: Jul. 11, 1997

[51] Int. Cl.[6] ..... B08B 9/06

[52] U.S. Cl. ..... 15/88; 15/88.4; 15/104.09; 15/104.095; 15/104.16

[58] Field of Search ..... 15/56, 59, 70, 15/71, 88, 88.4, 104.09, 104.095, 104.16, 104.2

[56] References Cited

U.S. PATENT DOCUMENTS

| | | | |
|---|---|---|---|
| 704,045 | 7/1902 | Hyden et al. . | |
| 2,152,036 | 3/1939 | Froh . | |
| 2,267,435 | 12/1941 | Thomas | 15/88 |
| 2,296,801 | 9/1942 | Thomas | 15/88 |
| 2,792,807 | 5/1957 | Cummings | 15/104.09 |
| 3,736,909 | 6/1973 | Marangoni et al. . | |
| 4,165,549 | 8/1979 | Wennerstrom | 15/88 |
| 4,208,754 | 6/1980 | Hille | 15/88.4 |
| 4,674,218 | 6/1987 | Bottomley . | |
| 4,726,137 | 2/1988 | Zurek et al. . | |
| 5,369,834 | 12/1994 | Groen et al. . | |
| 5,529,605 | 6/1996 | Müssig et al. . | |

*Primary Examiner*—Randall E. Chin
*Attorney, Agent, or Firm*—Senniger, Powers, Leavitt & Roedel

[57] ABSTRACT

Apparatus for removing residual contaminates from a section of pipe used in gas lines. The apparatus includes a frame and a cradle mounted on the frame for holding a section of pipe. The apparatus also includes a rigid rod moveably mounted on the frame for rotation about a centerline of the pipe when held by the cradle and for translation toward and away from the pipe. In addition, the apparatus includes a brush mounted on the rod for rotation and translation through the section of pipe when held by the cradle to dislodge residual contaminates inside the pipe.

12 Claims, 7 Drawing Sheets

200
106
108
26
220
208
208
210
212
216
214
218
206
204
202
192
78
192
192
94
192
190
190
190
190
186
152
186
152
186
152
186
152
186
152
186
184
184
184
184
184
188b
188a
180
182
182
182
182
182
182
176c
176d
176e
176b
176a
178
110
24
112
114
22

PIPE CLEANING APPARATUS

BACKGROUND OF THE INVENTION

This invention relates generally to pipe cleaning apparatus, and more particularly to apparatus for removing contaminates from the interior walls of sections of pipe used in gas lines.

Mercury and other contaminates, such as lead paint and naturally occurring radioactive materials, collect on the interior walls of pipe such as those used in natural gas lines. Some of these contaminates are naturally occurring and others leak into the lines from equipment used to measure and process the fluid transported in the pipe. Further, rust and scale form on the walls of the pipe and trap more contaminates on the walls. Pipe line owners periodically remove the contaminates from the lines to ensure purity of the fluid being transported. Moreover, when sections of pipe forming the pipe lines are taken out of service, it frequently is desirable to remove the contaminates before recycling or reusing the pipe to eliminate environmental and health-related concerns associated with some types of contaminates which may be present in the gas lines.

In the past, the sections of pipe were cleaned using steam, but present governmental regulations prevent use of this cleaning method and the method produces large amounts of contaminated waste. In addition, pipes have been cleaned previously by pulling heavy air hoses having cutters on them through the pipes. Although these apparatus worked well to remove scale, they were not very effective in removing contaminates such as mercury from pipes.

SUMMARY OF THE INVENTION

Among the several objects and features of the present invention may be noted the provision of an apparatus for removing contaminates from sections of pipe; the provision of such an apparatus which is movable between job sites; the provision of such an apparatus which loads and unloads pipe from the apparatus; the provision of such an apparatus which minimizes the amount of contaminated waste; and the provision of such an apparatus which adapts to staging and off-loading areas of various heights.

Briefly, apparatus of this invention comprises a frame and a cradle mounted on the frame for holding a section of pipe. The apparatus also comprises a rigid rod moveably mounted on the frame for rotation about a centerline of the pipe when held by the cradle and for translation toward and away from the pipe. In addition, the apparatus comprises a brush mounted on the rod for rotation and translation through the section of pipe when held by the cradle to dislodge residual contaminates inside the pipe.

In another aspect of the invention, the apparatus comprises a frame, a cradle mounted on the frame for holding a section of pipe, and a spindle rotatably mounted on the frame for rotation about a centerline of the pipe when held by the cradle. In addition, the apparatus comprises a rod connected to the spindle and a brush mounted on the rod for rotation with respect to the pipe as the rod rotates. Further, the apparatus comprises a mechanism for loading and unloading the pipe onto and off of the cradle before and after processing.

In yet another aspect of the present invention, the apparatus comprises a sub-frame, a frame positioned above the sub-frame, and a drive mechanism connected between the frame, and sub-frame for raising and lowering the frame with respect to the sub-frame. In addition, the apparatus comprises a cradle mounted on the frame for holding a section of pipe, a spindle rotatably mounted on the frame for rotation about a centerline of the pipe when held by the cradle, a rod connected to the spindle, and a brush mounted on the rod for rotation with respect to the pipe as the rod rotates.

Other objects and features of the invention will be in part apparent and in part pointed out hereinafter.

BRIEF DESCRIPTION OF THE DRAWINGS

Corresponding reference characters indicate corresponding parts throughout the several views of the drawings.

Detailed Description of the Preferred Embodiment

Figure 1:
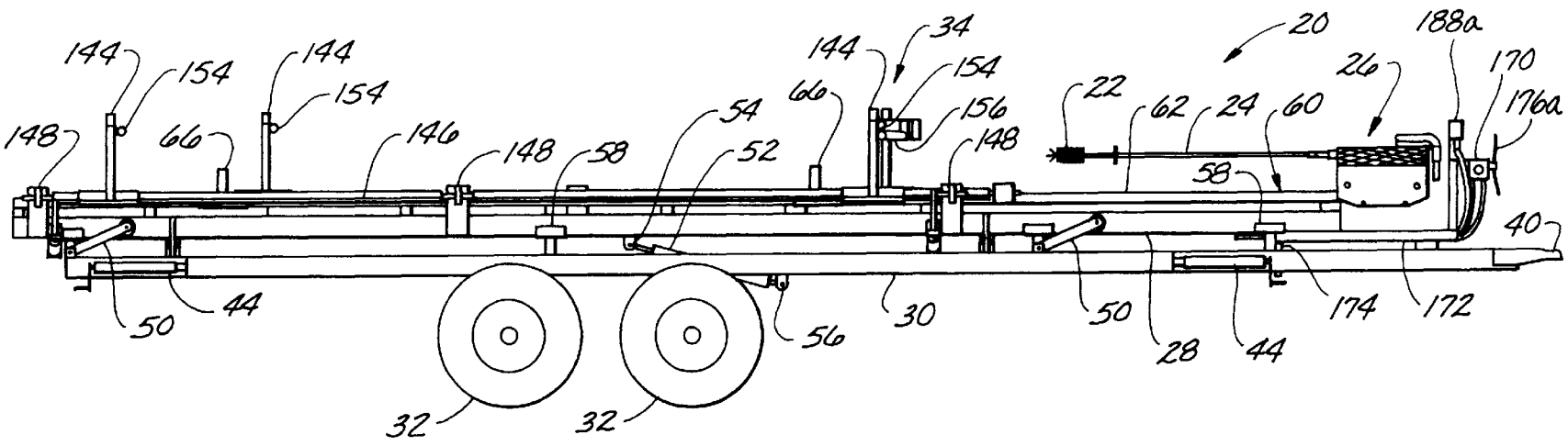
FIG. 1 is a side elevation of apparatus of the present invention for removing residual contaminates from a section of pipe used in a gas line.

Referring now to the drawings and in particular to FIG. 1, apparatus of the present invention for removing residual contaminates from sections of pipe is designated in its entirety by the reference numeral 20.

Figure 6:
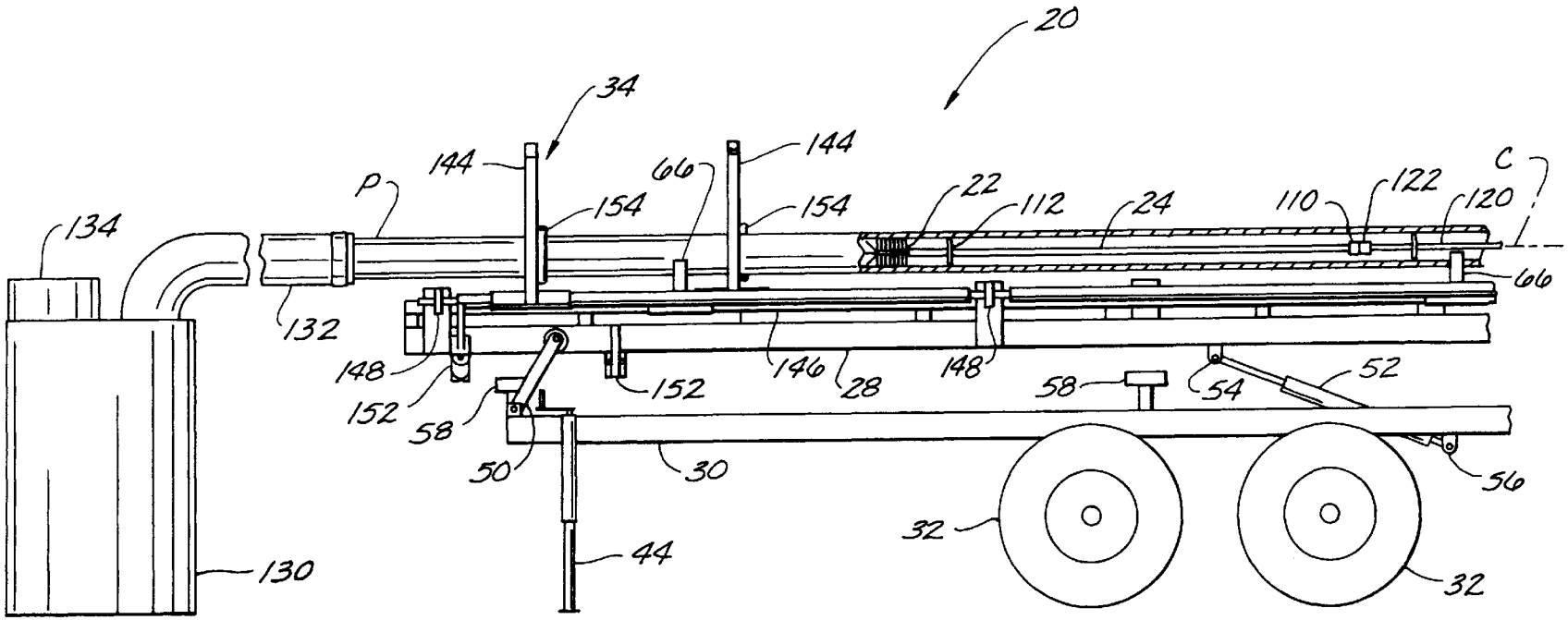
FIG. 6 is a side elevation of the apparatus shown with a frame in a raised position and partially broken away to show a brush and rod mounted on extenders.

In general, the apparatus 20 comprises a brush 22 mounted on a substantially rigid rod 24 attached to a head (generally designated 26) for rotating and translating the brush through a pipe P (FIG. 6). The head 26 is mounted on a frame 28 which is connected to a sub-frame: 30 mounted on wheels 32 for transporting the apparatus 20 between job sites. In addition, the apparatus 20 includes a mechanism, generally designated 34, for loading and unloading sections of pipe from the apparatus.

Figure 2:
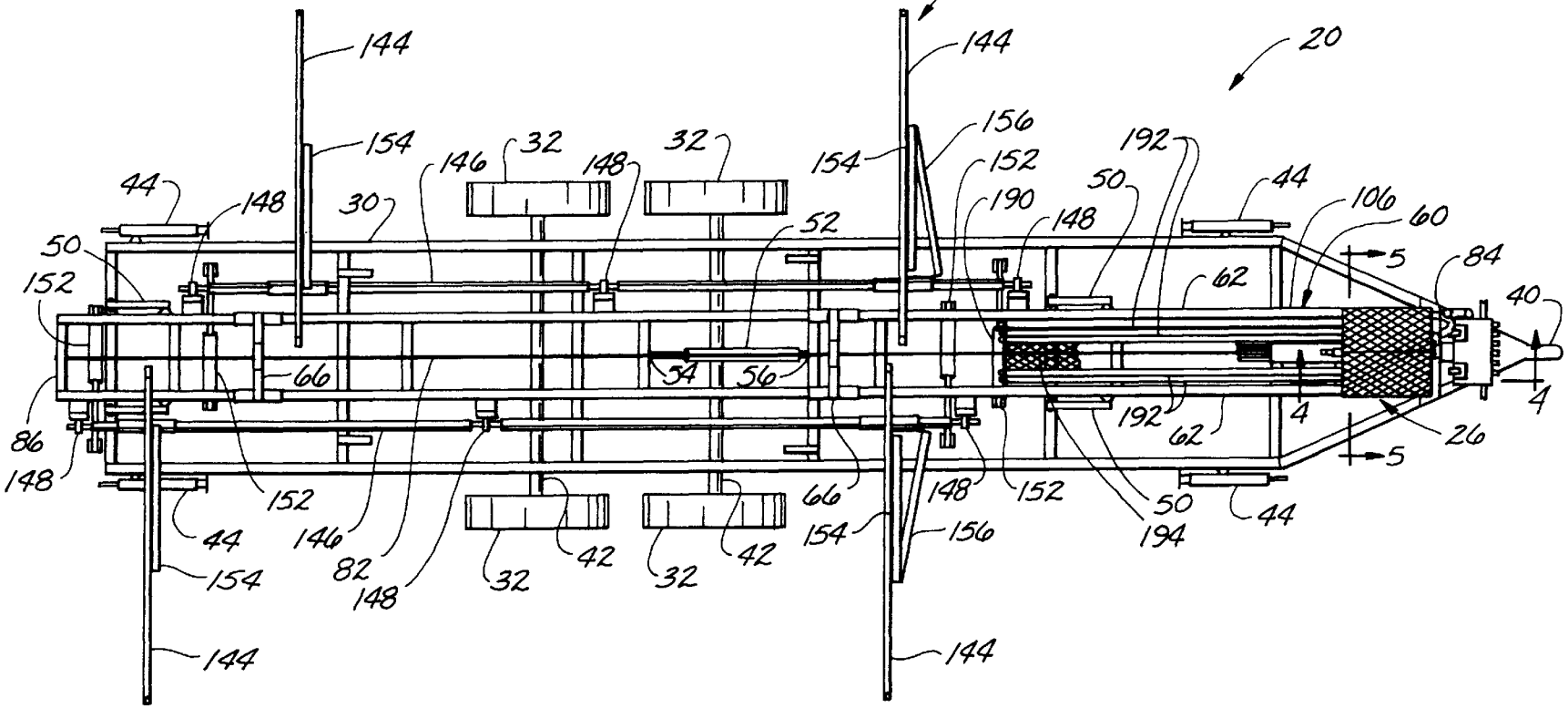
FIG. 2 is a top plan of the apparatus.

As illustrated in FIG. 2, the sub-frame 30 is a conventional trailer frame having a length sufficient to support the pipe P (FIG. 6) and the head 26 (e.g., 25 feet). The trailer includes a conventional trailer hitch 40 for connecting the trailer to a tow vehicle (not shown) and dual axles 42 with springs for mounting the sub-frame 30 on wheels 32. Four swivel jack stands 44 are mounted on the trailer, one adjacent each corner, for stabilizing the apparatus 20 when in use.

Referring again to FIG. 1, four links 50 (only two are visible in FIG. 1) are pivotally connected to the sub-frame 30 and the frame 28 for maintaining parallelism between the frame and sub-frame. A hydraulic cylinder 52 pivotally attached to the frame 28 and sub-frame 30 at locations 54 and 56, respectively, may be actuated to raise and lower the frame relative to the sub-frame as will be explained in greater detail later. Supports 58 spaced along the sub-frame 30 support the frame 28 when in the fully lowered position as shown in FIG. 1. Although other materials may be used to make the frame 28, the frame of the preferred embodiment are fabricated from 4"×2" rectangular steel tubing having a ¼" nominal wall thickness. Likewise, the link elements 50 may also be made from tubular stock.

Figure 3A:
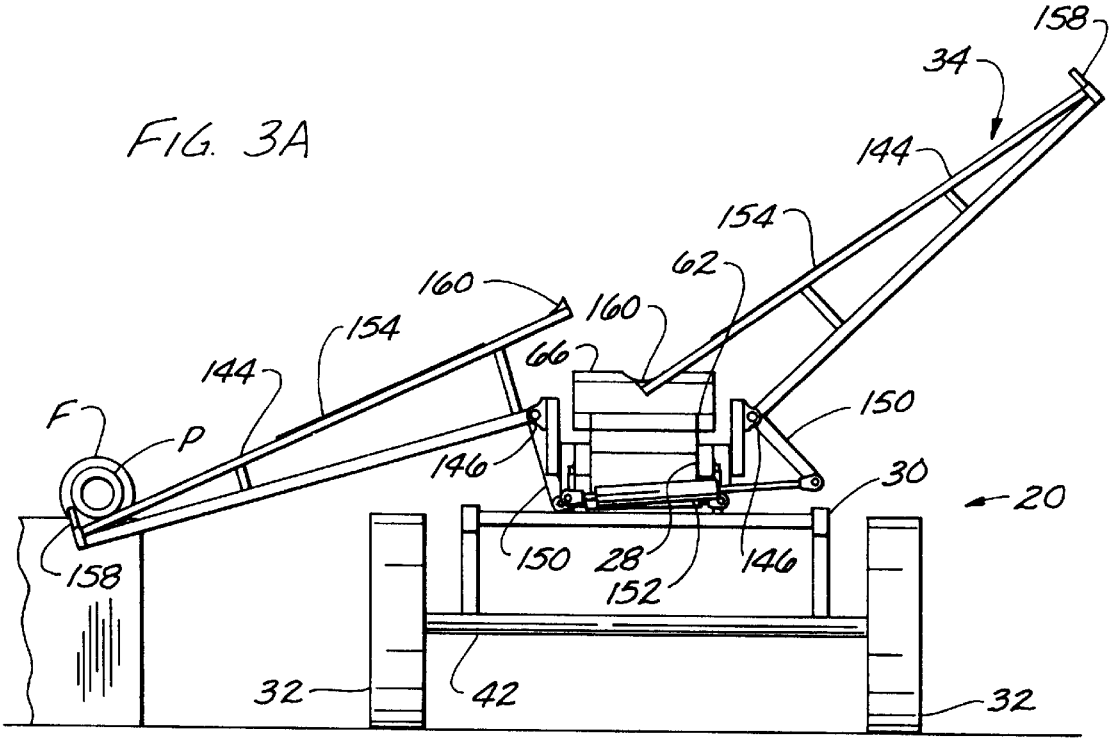
FIG. 3A is a rear elevation of the apparatus showing one arm of a loading/unloading mechanism in a lowered position.
Figure 5:
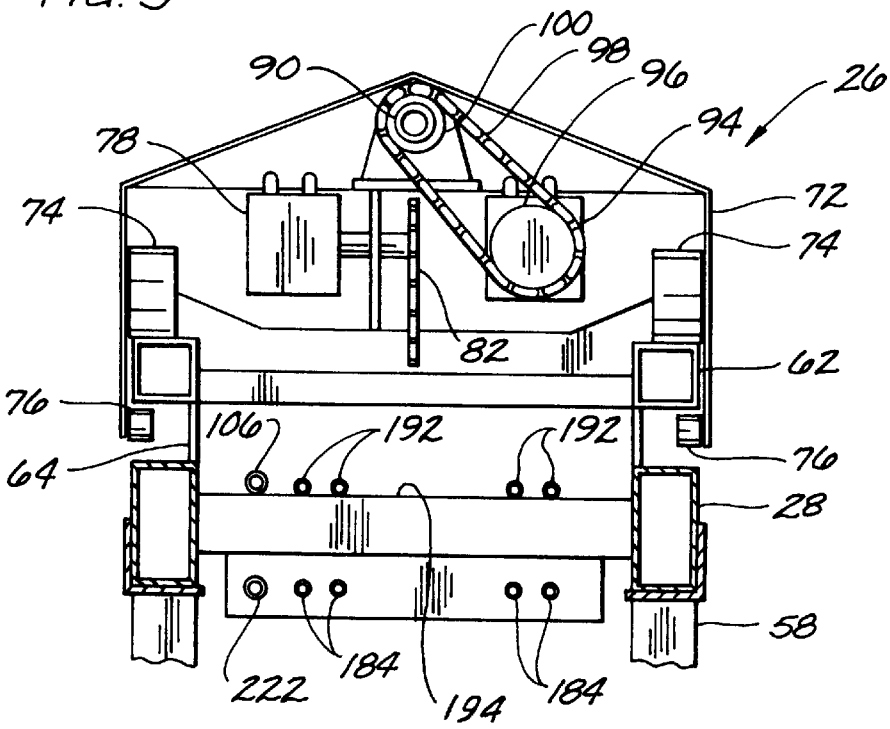
FIG. 5 is a cross section of a carriage of the apparatus taken in the plane of line 5—5 of FIG. 2.

A track, generally designated 60, comprising two rails 62 (e.g., 2" square tubing having a ⅛" nominal wall thickness) is mounted on the frame 28. The track 60 is spaced above the frame 28 with spacers 64 as shown in FIG. 5. As illustrated in FIG. 3A, two saddles 66 (only one is visible in FIG. 3A) are spaced along the track 60 to form a cradle for holding a section of pipe P. Although the saddles 66 may be permanently fixed to the track 60, in the preferred embodiment they are adjustable to vary their position along the track. Regardless of the position of the saddles 66 along the track 60, they hold the pipe P so that its centerline C extends parallel to the track 60 as shown in FIG. 6.

Figure 4:
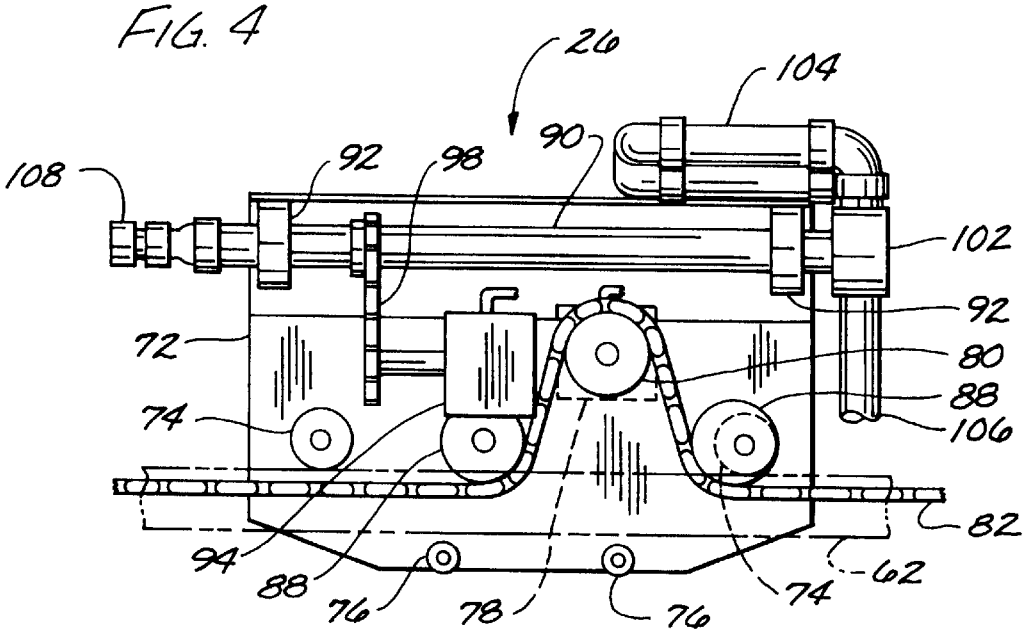
FIG. 4 is a cross section of a carriage of the apparatus taken in the plane of line 4—4 of FIG. 2.

The head 26 is mounted on the track 60. As illustrated in FIGS. 4 and 5, the head 26 comprises a carriage 72 having wheels 74 for rolling the carriage along the upper surfaces of the rails 62 for movement along the track 60. Smaller rollers 76 mounted below the rails 62 prevent the carriage 72 from lifting too far off the rails. A hydraulic motor or drive 78 housed in the carriage 72 drives a gear 80 which engages a chain 82 extending lengthwise between the rails 62 from a front mount 84 (FIG. 2) to a rear mount 86 (FIG. 2) to move the carriage back and forth along the track 60. As illustrated in FIG. 4, idler gears 88 are mounted to each side of the driven gear 80 to ensure engagement between the driven gear and the chain 82.

A spindle 90 is also housed in the carriage 72. The spindle 90 is held by two bearings 92 which permit it to rotate about the centerline C of a pipe P held by the cradle. As best illustrated in FIG. 5, a hydraulic motor or drive 94 mounted on the carriage 72 drives a gear 96 which engages a chain 98 wrapped around the gear and a gear 100 on the spindle 90 to rotate the spindle. As illustrated in FIG. 4, a swivel coupling 102 is connected to the forward end of the spindle 90. A pipe 104 is connected to the coupling 102 and a hose 106 is connected to the pipe for transporting pressurized air to the spindle 90. The hose 106 is connected to a remote pressurized air source such as a compressor (not shown) as will be explained in greater detail below. A high pressure quick disconnect coupling 108 is attached to the rearward end of the spindle 90 for connecting the rod 24 to the spindle as illustrated in FIG. 1.

Figures 8, 9, 10:
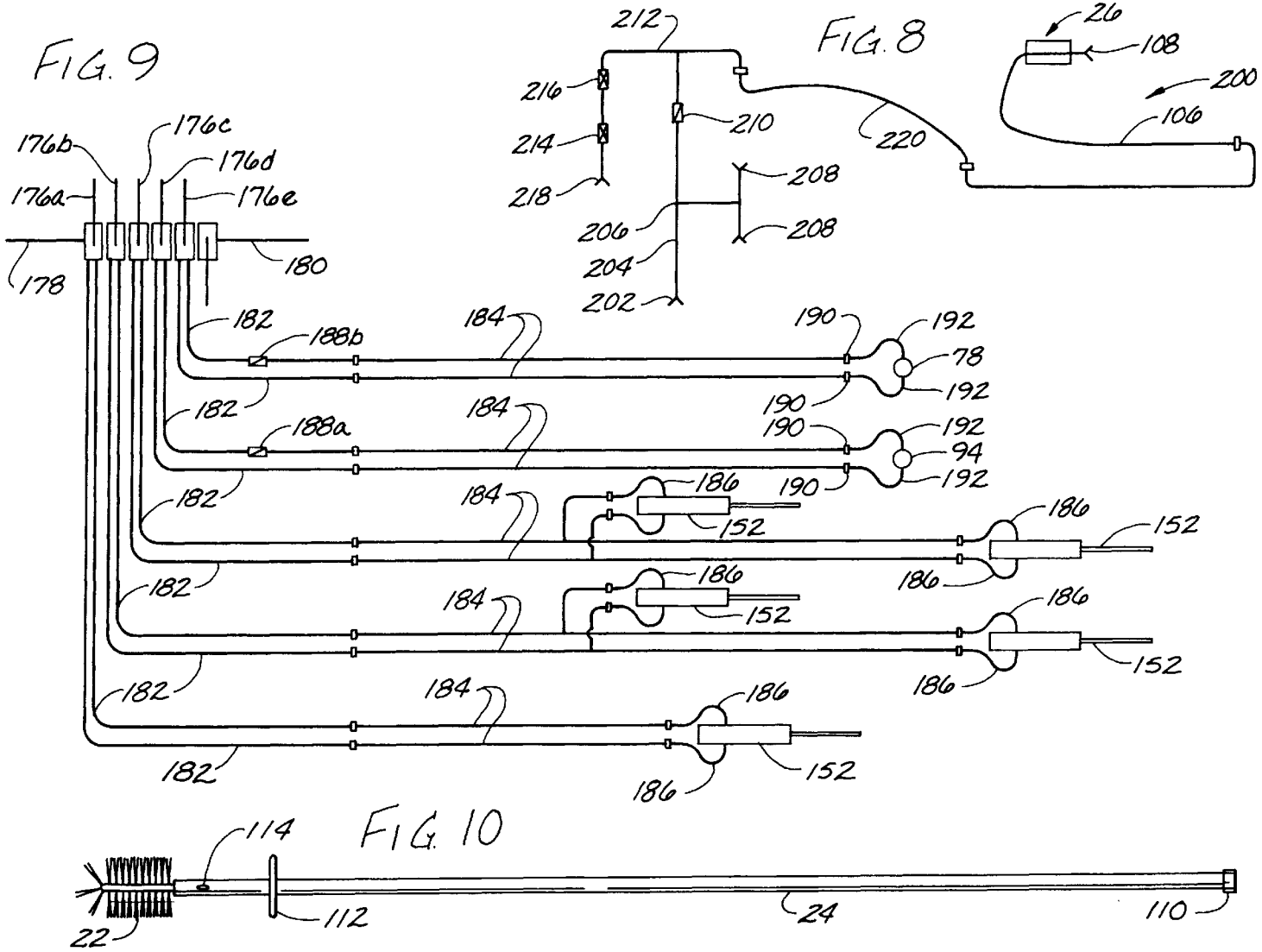
FIG. 8 is a schematic of an air system of the apparatus.
FIG. 9 is a schematic of an hydraulic system of the apparatus.
FIG. 10 is a detail showing a rod and brush of the present invention.

As illustrated in FIG. 10, the rod 24 is a substantially rigid hollow tube (e.g., ¾" tubing, five feet long) having a quick disconnect coupling 110 on one end for releasably fastening the rod to the quick disconnect coupling 108 on the rearward end of the spindle 90. The term "substantially rigid" is used herein to mean not intended to flex. The couplings 108, 110 are designed so that torque may be transmitted through the couplings. Thus, the rod 24 rotates with the spindle 90 as the motor 94 turns. A collar or bushing 112 is attached to the rod 24 near the end opposite the coupling 110 for engaging the interior wall of the pipe P. The bushing 112 has an outer diameter slightly small than or approximately equal to an internal diameter of the pipe P for centering the rod 24 in the pipe as it rotates and translates through the pipe. The brush 22 is mounted on the end of the rod 24 opposite the coupling 110. In an alternate embodiment (shown in FIG. 1), the bushing 112 may be omitted and the brush 22 may be relied upon to center the rod 24 in the pipe. As will be apparent to those skilled in the art, the brush 22 is rotated and translated through the pipe P as the spindle 90 rotates and the carriage 72 translates along the track 60 to dislodge rust, scale and contamination from the interior wall of the pipe. As previously described, the rod 24 is in communication with a remote pressurized air source. As illustrated in FIG. 10, holes 114 extend rearwardly through the rod 24 at an angle (e.g., 15°) for directing pressurized air into the pipe so that rust, scale, and other contamination dislodged by the brush 22 is blown away from the head 26.

The apparatus 20 also includes extension rods or extenders 120 which are identical to the rod 24 holding the brush 22 except the brush is replaced with a high pressure quick disconnect coupling 122 similar to the coupling 108 on the spindle 90 (FIG. 6). In addition, the holes 114 are omitted. One or more extenders 120 may connected between the spindle 90 and rod 24 to space the brush 22 farther from the carriage 72 so the brush may be pushed entirely through the section of pipe P as will be explained in greater detail below.

As shown in FIG. 6, a collection tank 130 is connected to the discharge end of the pipe P opposite the head 26 for collecting mercury, rust, scale, and other contamination, such as lead paint and naturally occurring radioactive materials, which is dislodged by the brush 22 and blown through the pipe. The collection tank 130 includes a flexible hose 132 for connecting the tank 130 to the pipe P. A filter 134 is attached to the vent of the collection tank 130 to prevent contaminates from being released into the atmosphere as the collection tank is filled.

Figure 3B:
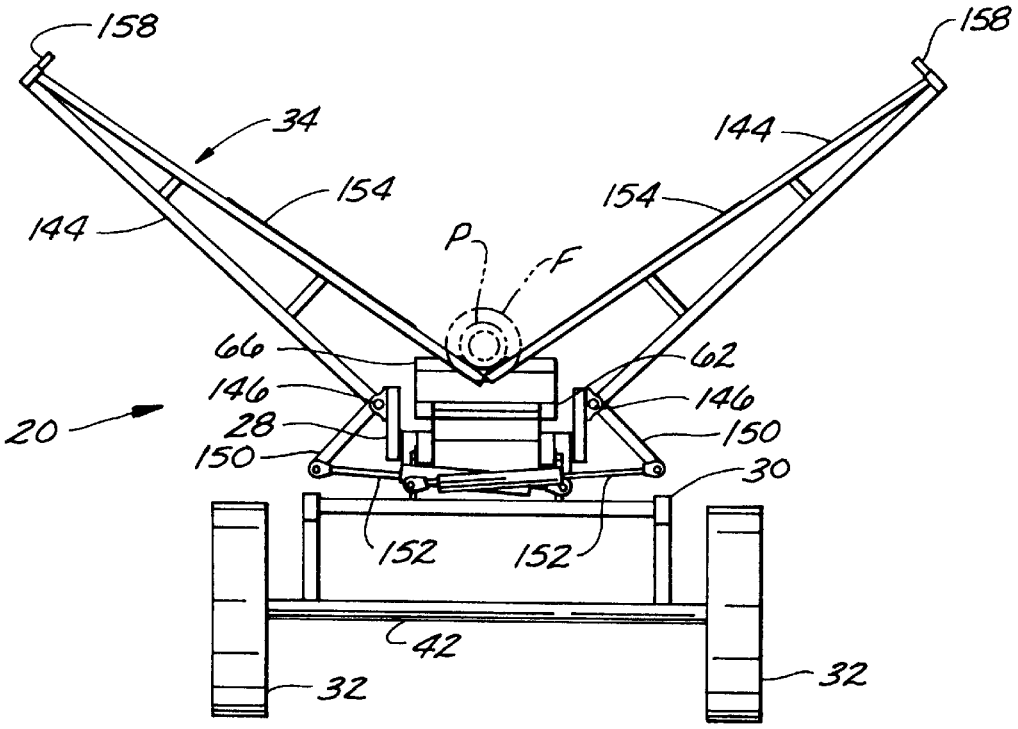
FIG. 3B is rear elevation of the apparatus showing both arms of the loading/unloading mechanism in raised positions.

As illustrated in FIG. 3A and 3B, the apparatus 20 includes mechanisms 34 for loading a section of pipe P onto the cradle for processing and for unloading the pipe from the cradle after processing. These mechanisms 34 are similar to each other. They comprise two arms 144 which extend outward from a pivotable bar 146 (FIG. 2) mounted on bearings 148 attached to the sides of the frame 28. Two lever arms 150 extend outward from each of the pivotable bars 146. Hydraulic cylinders 152 are pivotably connected between the lever arms 150 and frame 28 so the arms 144 are raised and lowered in response to the corresponding cylinders 152 being extended and contracted. As illustrated in FIG. 2, each of the arms 1441 has an upper roller 154 which permits the pipe to slide lengthwise so the pipe may be positioned in the cradle. In addition, the forward arms 144 include angled rollers 156 which engage a flange F on one end of the pipe P as it rolls toward the cradle to automatically locate the pipe at an appropriate position for cleaning. As illustrated in FIG. 3A & 3B, a removable pin 158 extends upward from the outboard ends of the arms 144 to prevent pipes from rolling off the ends. Further, the inboard ends of the arms 144 include inclined sections 160 for directing pipes P outward along the appropriate arms as the pipe is unloaded from the cradle.

Figure 7:
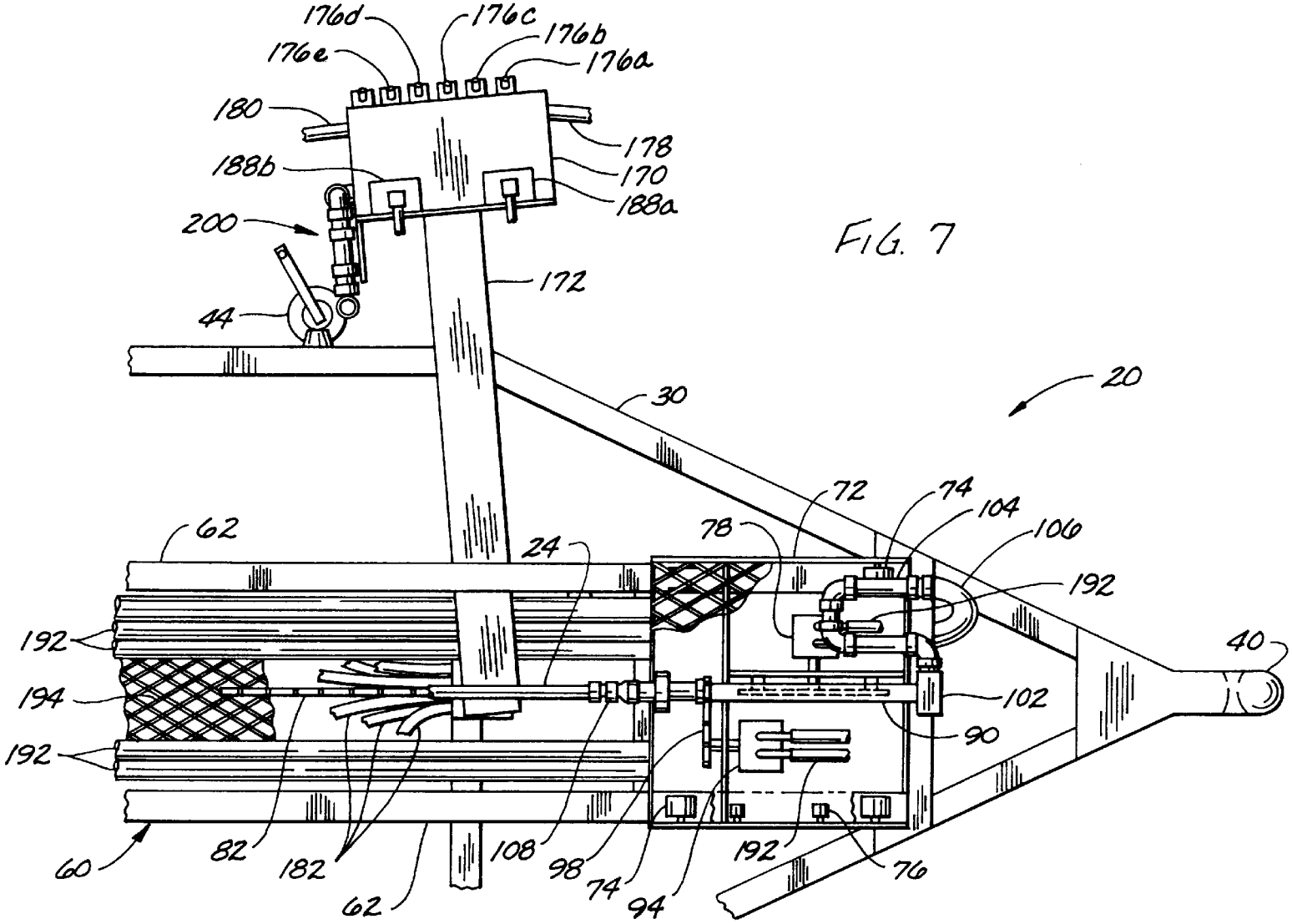
FIG. 7 is a detail of FIG. 2 showing a control pedestal in a pivoted position.

As shown in FIG. 7, a control console 170 is mounted on a cantilevered arm 172 which is pivotally attached to the sub-frame 30 by a hinge 174 (FIG. 1) so the console can swing to either side of the apparatus 20 during use (as shown in FIG. 7) or may be stored over the trailer tongue (as shown in FIG. 1) when the apparatus is being transported between job sites. The console 170 includes a bank of five valves 176*a*–176*e* for controlling various functions of the apparatus 20. The console 170 may also include one or more spare valves for field repair. An input hose 178 delivers hydraulic fluid to the bank of valves from a remote source (not shown) and a return hose 180 connected to the source completes the circuit.

As best illustrated in FIG. 9, valve 176*a* controls the hydraulic cylinder 52 for raising and lowering the frame 28 with respect to the sub-frame. Two flexible hoses 182 extend downward from the bottom of the valve 176*a* and travel through the arm 172 to a point behind the hinges 174 where they are connected to steel tubing 184. This tubing extends to a point adjacent the cylinder 52 where it connects to flexible hoses 186 to accommodate the movement of the cylinder as it raises and lowers the frame 28. Those skilled in the art will appreciate that the hoses 182 are shielded by the control console arm 172. When the valve 176*a* is moved in one direction from neutral (e.g., upward), hydraulic fluid travels through the respective hoses and tubes to the appropriate port of the hydraulic cylinder 52 to raise the frame 28 with respect to the subframe 30. When the valve 176*a* is moved in the opposite direction, fluid travels to the appropriate port of the cylinder 52 to lower the frame 28.

In a similar manner, valves 176*b* & 176*c* control the hydraulic cylinders 152 for pivoting the arms 144 of the respective loading/unloading mechanisms 34. Two flexible hoses 182 extend downward from the bottom of each valve 176*b,* 176*c* and through the arm 172 to a point behind the hinge 174 where they are connected to steel tubing 184. This tubing 184 extends to a point adjacent the cylinders 152 where it connects to flexible hoses 186 to accommodate the movement of the cylinders 152 as they pivot the respective arms 144 up and down. When the valves 176*b,* 176*c* are moved in one direction from neutral (e.g., upward), hydraulic fluid travels through the respective hoses and tubing to the appropriate ports of the hydraulic cylinders 152 to pivot the respective arms 144 upward. When they are moved in the opposite direction, fluid travels to the appropriate port of the cylinders 152 to pivot the arms 144 downward.

Valve 176*d* controls the brush rotation. Two flexible hoses 182 extend from the bottom of the valve 176*d.* One of these hoses 182 extends up through a flow control valve 188*a* mounted on the console above the bank of valves 176*a*–176*e* and then downward through the arm 172 of the console 170 to a point behind the hinge 174 where it joins steel tubes 184. The other hose 182 also extends through the arm 172 to join the tubing 184. The tubes 184 extend rearward to fittings 190 mounted on the frame 28. Flexible hoses 192 extend forward from the fittings 190 to carry hydraulic fluid to ports on the motor 94 which rotates the brush 22. The hoses 192 lay in a tray 194 formed by expanded metal attached between the channel sections forming the frame 28. Moving the valve upward and downward rotates the brush in opposite directions. Thus, a first pass through the pipe may be made with the brush 22 turning in one direction, and a second pass may be made with the brush turning in the opposite direction for additional cleaning provided the couplings permit torque transmission in both directions. The control valve 188*a* may be adjusted to change the speed of the brush rotation.

Similarly, valve 176*e* controls the carriage 72 travel forward and rearward along the track 60. Two flexible hoses 182 extend from the bottom of the valve 176*e.* One of these hoses 182 extends up through a second flow control valve 188*b* mounted on the console 170 and then downward through the arm 172 to a point behind the hinge 174 where it joins steel tubing 184. The other hose 182 also extends through the arm 172 to join the tubing 184. The tubes 184 extend rearward to the fittings 190 mounted on the frame 28. Flexible hoses 192 extend forward from the fittings 190 to carry hydraulic fluid to ports on the drive 78 for driving the carriage 72. The hoses 192 lay in the tray 194. Moving the valve upward and downward moves the carriage 72 in opposite directions (e.g., rearward and forward, respectively). The control valve 188*b* may be adjusted to change the speed at which the carriage 72 travels along the track 60.

As schematically illustrated in FIG. 8, the air travels from a remote source (not shown) to the spindle 90 via an air supply system, generally designated 200. The system 200 includes a quick disconnect coupling 202 for connecting the system to the remote source. A steel pipe 204 extends from the coupling 202 to a tee :206 having two or more quick disconnect couplings 208 of various sizes (e.g., ⅜" and ¾") so that impact wrenches and other pneumatic tools (not shown) may be connected to the air source. The impact wrenches are useful for removing plugs and instrumentation from the pipes. A main ball valve 210 is installed along the pipe downstream of the tee 206 so it does not affect operation of the impact wrenches. The main valve 210 is operable to selectively prevent air flow to the rest of the system 200.

A branch 212 downstream from the main valve 210 is provided for introducing other fluids through the rod 24. For instance, a solution of soap and water may be injected into the rod 24 to aid in cleaning the pipe P. The branch 212 includes a ball valve 214 for selectively preventing flow through the branch and a needle valve 216 for controlling the flow rate of fluid traveling through the branch. A quick disconnect coupling 218 (e.g., a ⅜" coupling) is attached to the end of the branch 212 for connecting the solution source (not shown) to the branch. The solution source has a higher pressure than the air in the system 200 to prevent the air from flowing into the solution source. The valves 210, 214, 216 and quick disconnect couplings 202, 208, 218 are positioned on the control console 170. A flexible hose 220 connected to the end of the pipe 204 extends through the arm 172 of the control console 170 to a point behind the hinge 174 where it connects to a steel tube 222 (FIG. 5). The tube 222 extends rearward to the ganged fitting 190 where it is joined to the hose 106 which supplies the spindle 90. The hose 106 also lays in the tray 194 formed between the channels of the frame 28.

To use the apparatus 20, the sub-frame 30 is wheeled between an input rack in a staging area and an output rack in an off-load area. The frame 28 is adjusted by operating the valve 176*a* to a comfortable level for the operator. In addition, the control console 170 may be pivoted on the hinge 174 to position it for convenient access by the operator. The arms 144 on the side of the apparatus 20 facing the staging area are lowered by moving either valve 176*b* or 176*c* in the appropriate direction (e.g., downward). A pipe P in the staging area is rolled along the rack over top of the arms 144 and the same valve is moved in the opposite direction to raise the arms. As the arms 144 pivot upward, the pipe P rolls toward the cradle. The arms 144 on the opposite loading/unloading mechanism 34 may be raised as shown in FIG. 3A to prevent the pipe from rolling off the cradle. As the pipe reaches the cradle, the rearward face of the pipe flange F engages the oblique rollers 156 on the arms 144 to move the pipe forward with respect to the trailer so the pipe comes to rest in the cradle at an appropriate position. Alternatively, the frame saddles 144 and arms 144 may be adjusted so they are level with the input and output racks so the pipes may be rolled along the arms to the saddle without further adjustment of the loading/unloading mechanism 34.

The operator connects the hose 132 of the collection tank 130 to the discharge end of the pipe adjacent the rear end of the trailer. The operator then aligns the brush 22 with the centerline C of the pipe P and guides the brush toward the opening in the pipe as the valve 176*e* is positioned to move the head 26 toward the pipe. Once the brush 22 is inserted in the opening, the main air system valve 210 is opened to direct air through the rod 24 and the valve 176*d* is positioned to rotate the brush while the carriage 72 travels along the track 60 toward the pipe.

Typically, the pipes being cleaned are longer than the rod 24. For instance, the pipe P may be twenty feet long and the rod 24 may be only five feet long. Thus, when the carriage 72 is almost against the opening in the pipe, the rod 24 is disconnected from the spindle 90 and the direction of carriage travel is reversed to return the carriage to its beginning position. The spindle rotation is stopped while an extender 120 is connected between the spindle 90 and the rod 24. Then, the spindle 90 rotation is restarted and the carriage 72 is moved toward the pipe, pushing the brush 22 farther through the pipe. This process may be repeated until the brush 22 is pushed entirely through the pipe. The process is reversed to remove brush 22 from the pipe.

In an alternative method, the sub-frame 30 is wheeled to a rack holding sections of pipe so the rear end of trailer is adjacent the rack and the track 60 is parallel with the pipes held by the rack. The frame 28 is adjusted by operating the valve 176*a* so the spindle 90 is level with the pipes. Extenders 120 are connected between the spindle 90 and rod 24 so the distance between the brush 22 and the carriage 72 is greater than or equal to the length of the pipe. One of the sections of pipe is rolled along the rack so it is aligned with the spindle, and the operator connects the hose 132 of the collection tank 130 to the discharge end of the pipe opposite the rear end of the trailer. The operator then aligns the brush 22 with the centerline C of the pipe P as in the previously described method and guides the brush toward the opening in the pipe as the valve 176*e* is positioned to move the head 26 toward the pipe. Once the brush 22 is inserted in the opening, the main air system valve 210 is opened to direct air through the rod 24 and the valve 176*d* is positioned to rotate the brush while the carriage 72 travels along the track 60 toward the pipe. Because the brush 22 is spaced from the carriage 72 by a distance greater than or equal to the length of the sections of pipe, the cleaning operation may be completed in one pass without backing up the carriage 72 to add extenders 120.

As will be apparent to those skilled in the art, the valve 214 in the solution delivery branch 212 may be opened to send liquid such as water or a soap solution through the rod 24 as the brush 22 is rotated and translated through the pipe P to provide additional cleaning. The needle valve 216 may also be adjusted to provide the desired flow rate of liquid through the rod 24.

Once the brush is pushed entirely through the pipe and the pipe is cleaned, the brush 22 is withdrawn from the pipe P by reversing the process as explained above. The hose 132 connected to the collection tank 130 is removed from the pipe and capped. The arms 144 facing the off-load area are pivoted downward by actuating valve 176*b* or 176*c*. As the arms 144 pivot downward, the inclined sections 160 on the arms lift the pipe P out of the saddles 166 and the pipe rolls down the arms 144 to an awaiting output rack.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for removing residual contaminates from a section of pipe used in gas lines, the apparatus comprising:

a frame;

a cradle mounted on the frame for holding a section of pipe;

a rigid rod moveably mounted on the frame for rotation about a centerline of the pipe when held by the cradle and for translation toward and away from the pipe;

a brush mounted on the rod for rotation and translation through the section of pipe when held by the cradle to dislodge residual contaminates inside the pipe; and a collection tank connectable to a discharge end of the pipe for collecting residual contaminates when dislodged by the brush.

2. Apparatus as set forth in claim 1 wherein the rod has a hollow interior and the apparatus further comprises a pressurized fluid source in communication with the interior of the rod for blowing fluid through the pipe as the brush is rotated and translated through the pipe to blow dislodged residual contaminates through the discharge end of the pipe toward the tank.

3. Apparatus as set forth in claim 2 wherein the pressurized fluid source includes an air source.

4. Apparatus as set forth in claim 2 wherein the pressurized fluid source includes a cleaning solution source.

5. Apparatus for removing residual contaminates from a section of pipe used in gas lines, the apparatus comprising:

a frame;

a cradle mounted on the frame for holding a section of pipe;

a rigid rod moveably mounted on the frame for rotation about a centerline of the pipe when held by the cradle and for translation toward and away from the pipe;

a brush mounted on the rod for rotation and translation through the section of pipe when held by the cradle to dislodge residual contaminates inside the pipe;

a track mounted on the frame and extending parallel to the centerline of the pipe when held by the cradle;

a carriage mounted on the track for movement toward and away from the pipe;

a drive for moving the carriage along the track toward and away from the pipe;

a spindle rotatable mounted on the carriage for rotation about the centerline of the pipe when held by the cradle, wherein the rod is connected to the spindle for movement into and out of the pipe as the drive moves the carriage along the track;

a motor for rotating the spindle about the centerline of the pipe; and an extender connectable between the rod and the spindle for spacing the brush farther from the carriage to enable the brush to be pushed farther through the pipe.

6. Apparatus for removing residual contaminates from a section of pipe used in gas lines, the apparatus comprising:

a frame;

a cradle mounted on the frame for holding a section of pipe;

a rigid rod moveably mounted on the frame for rotation about a centerline of the pipe when held by the cradle and for translation toward and away from the pipe;

a brush mounted on the rod for rotation and translation through the section of pipe when held by the cradle to dislodge residual contaminates inside the pipe; and a mechanism for loading a section of pipe onto the cradle for processing comprising an arm pivotably attached to the frame for picking up a section of pipe from a staging area adjacent the apparatus and loading the section onto the cradle for processing.

7. Apparatus as set forth in claim 6 wherein the arm is a first arm and the apparatus further comprises a second arm pivotably attached to the frame for picking up the section of processed pipe from the cradle and moving the pipe to an off-load area adjacent the apparatus for unloading the section from the cradle.

8. Apparatus for removing residual contaminates from a section of pipe used in gas lines, the apparatus comprising:

a frame;

a cradle mounted on the frame for holding a section of pipe;

a rigid rod moveably mounted on the frame for rotation about a centerline of the pipe when held by the cradle and for translation toward and away from the pipe;

a brush mounted on the rod for rotation and translation through the section of pipe when held by the cradle to dislodge residual contaminates inside the pipe;

a sub-frame positioned below the frame; and a drive mechanism connected between the frame and sub-frame for raising and lowering the frame with respect to the sub-frame to adjust a working height of the cradle.

9. Apparatus for removing residual contaminates from a section of pipe used in gas lines, the apparatus comprising:

a frame;

a cradle mounted on the frame for holding a section of pipe;

a spindle rotatably mounted on the frame for rotation about a centerline of the pipe when held by the cradle;

a rod connected to the spindle;

a brush mounted on the rod for rotation with respect to the pipe as the rod rotates; and a mechanism for loading and unloading the pipe onto and off of the cradle before and after processing comprising an arm pivotably attached to the frame for picking up a section of pipe from a staging area adjacent the apparatus and loading the section onto the cradle for processing.

10. Apparatus as set forth in claim 9 wherein said mechanism further comprises a drive mounted between the arm and frame for pivoting the arm upward for picking up the section of pipe from the staging area adjacent the apparatus.

11. Apparatus as set forth in claim 9 wherein the arm is a first arm and the apparatus further comprises a second arm pivotably attached to the frame for picking up the section of processed pipe from the cradle and moving the pipe to an off-load area adjacent the apparatus for unloading the section off of the cradle.

12. Apparatus for removing residual contaminates from a section of pipe used in gas lines, the apparatus comprising:

a sub-frame;

a frame positioned above the sub-frame;

a drive mechanism connected between the frame and sub-frame for raising and lowering the frame with respect to the sub-frame;

a cradle mounted on the frame for holding a section of pipe;

a spindle rotatably mounted on the frame for rotation about a centerline of the pipe when held by the cradle;

a rod connected to the spindle; and a brush mounted on the rod for rotation with respect to the pipe as the rod rotates.

* * * * *